US010155400B2

(12) United States Patent
Mataki

(10) Patent No.: US 10,155,400 B2
(45) Date of Patent: Dec. 18, 2018

(54) PRINTING APPARATUS AND PRINTING METHOD

(71) Applicant: FUJIFILM Corporation, Tokyo (JP)

(72) Inventor: Hiroshi Mataki, Kanagawa (JP)

(73) Assignee: FUJIFIRM Corporation, Tokyo (JP)

( * ) Notice: Subject to any disclaimer, the term of this patent is extended or adjusted under 35 U.S.C. 154(b) by 0 days.

(21) Appl. No.: 15/657,218

(22) Filed: Jul. 24, 2017

(65) Prior Publication Data

US 2018/0029385 A1 Feb. 1, 2018

(30) Foreign Application Priority Data

Jul. 26, 2016 (JP) ..... 2016-146544

(51) Int. Cl.

| | |
|---|---|
| ***B41J 11/00*** | (2006.01) |
| ***B41M 7/00*** | (2006.01) |
| ***B41F 23/08*** | (2006.01) |

(52) U.S. Cl.

CPC ..... *B41J 11/0015* (2013.01); *B41F 23/08* (2013.01); *B41J 11/002* (2013.01); *B41M 7/009* (2013.01); *B41M 7/0036* (2013.01)

(58) Field of Classification Search

CPC ..... B41J 11/0015

See application file for complete search history.

(56) References Cited

U.S. PATENT DOCUMENTS

| | | | | |
|---|---|---|---|---|
| 7,451,698 | B2 | 11/2008 | Schneider et al. | |
| 9,221,279 | B2 | 12/2015 | Houjou | |
| 2006/0075917 | A1* | 4/2006 | Edwards | B41J 11/0015 101/483 |
| 2016/0222238 | A1* | 8/2016 | Arai | C09D 11/102 |

FOREIGN PATENT DOCUMENTS

| | | |
|---|---|---|
| JP | 2005-199718 | 7/2005 |
| JP | 2015-164786 | 9/2015 |

OTHER PUBLICATIONS

"Search Report of Europe Counterpart Application", dated Jan. 3, 2018, p. 1-p. 5.

* cited by examiner

*Primary Examiner* — Shelby L Fidler
(74) *Attorney, Agent, or Firm* — JCIPRNET

(57) ABSTRACT

A printing apparatus and a printing method that can reduce a difference in glossiness in an in-plane direction of a printed matter to which aqueous varnish has been applied. The apparatus and method satisfy a relationship of "Tp−(40/6)× tw≤a" when the temperature of a recording surface at the time of application of aqueous varnish containing water is denoted by Tp, coating formation time of the aqueous varnish is denoted by tw, and a constant determined according to an allowable value of a gloss difference, which is a difference between glossiness of the recording surface of a printed matter of which applied aqueous varnish has been dried in a first direction and glossiness of the recording surface in a direction orthogonal to the first direction, is denoted by a. Here, the unit of the temperature Tp is ° C. and the unit of the coating formation time tw is minute.

10 Claims, 8 Drawing Sheets

| VARNISH NAME | UPPER LIMIT OF TEMPERATURE OF RECORDING SURFACE [°C] |
|---|---|
| W7515 | 80 |
| W3950 | 60 |
| HYDLITH2012 | 60 |
| W7777 | 40 |

PRINTING APPARATUS AND PRINTING METHOD

CROSS-REFERENCE TO RELATED APPLICATIONS

The present application claims priority under 35 U.S.C. § 119 to Japanese Patent Application No. 2016-146544, filed on Jul. 26, 2016. The above application is hereby expressly incorporated by reference, in its entirety, into the present application.

BACKGROUND OF THE INVENTION

1. Field of the Invention

The present invention relates to a printing apparatus and a printing method, and more particularly, to a printing apparatus and a printing method that perform printing and the application of aqueous varnish in an in-line manner.

2. Description of the Related Art

A printing apparatus, which ejects liquid from nozzles of a liquid ejection head to record an image on the recording surface of a recording medium, is known. Further, varnish is applied to the surface of a recording medium, on which an image has been recorded, to improve the gloss of a printed matter and to protect the printed matter from scratches and the like.

For example, JP2005-199718A discloses a varnishing unit that coats a printed matter to protect the surface of the printed matter and to improve the gloss of the surface of the printed matter.

Further, JP2015-164786A discloses an image recording apparatus that heats the image surface of a media on which an image has been recorded with ink containing a wax component to dry the ink and applies active light-curable varnish to the image surface of the media of which the ink has been dried.

SUMMARY OF THE INVENTION

It is found that a difference occurs between glossiness in a transport direction of a printed matter and glossiness in a direction perpendicular to the transport direction in the case of some kinds of aqueous varnish when aqueous varnish is applied in an in-line manner after the image is printed with ink. This problem is not recognized in JP2005-199718A and JP2015-164786A.

The invention has been made in consideration of the above-mentioned circumstances, and an object of the invention is to provide a printing apparatus and a printing method that reduce a difference in glossiness in an in-plane direction of a printed matter to which aqueous varnish has been applied.

In order to achieve the object, an aspect of a printing apparatus comprises a recording section that records an image on a recording surface of a recording medium with ink, a drying section that heats the recording medium to dry the ink of the recording surface, and a varnish application section that applies aqueous varnish containing water to the recording surface in a first direction after the recording medium is heated by the drying section. When the temperature of the recording surface at the time of application of the aqueous varnish is denoted by Tp, coating formation time of the aqueous varnish is denoted by tw, and a constant determined according to an allowable value of a gloss difference, which is a difference between glossiness of the recording surface of a printed matter of which the applied aqueous varnish has been dried in the first direction and glossiness of the recording surface in a direction orthogonal to the first direction, is denoted by a, a relationship of "$Tp-(40/6)\times tw \leq a$ . . . (Expression A)" is satisfied.

Here, the unit of the temperature Tp is ° C. and the unit of the coating formation time tw is minute.

According to this aspect, it is possible to reduce a difference in glossiness in an in-plane direction of the printed matter to which aqueous varnish has been applied.

It is preferable that a relationship of "$a=5.2\times Gp-26$" is satisfied when the allowable value is denoted by Gp. Accordingly, the constant a can be appropriately defined.

It is preferable that the coating formation time tw is time that has passed until wrinkles are formed on the aqueous varnish present in a plastic vessel which includes a flat bottom having a diameter of 60 mm and in which 5 g of the aqueous varnish is put when the vessel is horizontally placed on a plate having a temperature of 80° C. and is then inclined at an angle of 45° with respect to the horizon. Accordingly, the coating formation time tw can be appropriately defined.

It is preferable that the printing apparatus further comprises a pretreatment section disposed between the drying section and the varnish application section and adjusting the temperature of the recording surface of the recording medium. Accordingly, it is possible to adjust the temperature of the recording surface of the recording medium at the time of application of the aqueous varnish to an appropriate temperature.

It is preferable that the pretreatment section comprises a blowing unit blowing air to the recording surface. Accordingly, it is possible to appropriately adjust the temperature of the recording surface of the recording medium.

The pretreatment section may comprise a temperature adjusting roller that is in contact with the recording medium and rotates. Accordingly, it is possible to appropriately adjust the temperature of the recording surface of the recording medium.

It is preferable that the printing apparatus further comprises an acquisition section acquiring the constant a and the coating formation time tw of aqueous varnish to be used and a calculation section calculating an upper limit of temperature Tp satisfying Expression A at the acquired constant a and the acquired coating formation time tw, and the pretreatment section adjusts the temperature of the recording surface of the recording medium to a temperature lower than the upper limit of the temperature Tp. Accordingly, since the temperature of the recording surface can be adjusted to a low temperature, the relationship of Expression A can be satisfied. Therefore, it is possible to reduce a difference in glossiness in the in-plane direction of the printed matter to which the aqueous varnish has been applied.

The printing apparatus may comprise a table storing an upper limit of the temperature Tp corresponding to each kind of the aqueous varnish. Accordingly, it is possible to appropriately acquire the upper limit of the temperature Tp.

The printing apparatus may further comprise an acquisition section that acquires the constant a and the temperature Tp of the recording surface of the recording medium adjusted by the pretreatment section, a calculation section that calculates a lower limit of coating formation time tw satisfying Expression A at the acquired constant a and the acquired temperature Tp, and a selection section that selects aqueous varnish having coating formation time tw longer than the calculated lower limit of the coating formation time tw. Accordingly, since aqueous varnish having a long coating formation time can be selected, the relationship of Expression A can be satisfied. Therefore, it is possible to reduce a difference in glossiness in the in-plane direction of the printed matter to which the aqueous varnish has been applied.

It is preferable that the varnish application section comprises a varnish applying roller being in contact with the recording surface of the recording medium and transferring and applying aqueous varnish, which is held on the surface of the varnish applying roller, to the recording surface. Accordingly, the aqueous varnish can be appropriately applied.

In order to achieve the object, an aspect of a printing method comprises a recording step of recording an image on a recording surface of a recording medium with ink, a drying step of heating the recording medium to dry the ink of the recording surface, and a varnish applying step of applying aqueous varnish containing water to the recording surface in a first direction after the recording medium is heated in the drying step. When the temperature of the recording surface at the time of application of the aqueous varnish is denoted by Tp, coating formation time of the aqueous varnish is denoted by tw, and a constant determined according to an allowable value of a gloss difference, which is a difference between glossiness of the recording surface of a printed matter of which the applied aqueous varnish has been dried in the first direction and glossiness of the recording surface in a direction orthogonal to the first direction, is denoted by a, a relationship of "$Tp-(40/6)\times tw \leq a$ . . . (Expression B)" is satisfied. Here, the unit of the temperature Tp is ° C. and the unit of the coating formation time tw is minute.

According to this aspect, it is possible to reduce a difference in glossiness in the in-plane direction of the printed matter to which the aqueous varnish has been applied.

Further, a non-temporary recording medium in which a code, which can be read by a computer, of a program is recorded is also included in this aspect.

According to the invention, it is possible to reduce a difference in glossiness in the in-plane direction of the printed matter to which the aqueous varnish has been applied.

DESCRIPTION OF THE PREFERRED EMBODIMENTS

Preferred embodiments of the invention will be described in detail below with reference to accompanying drawings.

First Embodiment

[Entire Structure of Ink Jet Recording Apparatus]

Figure 1:
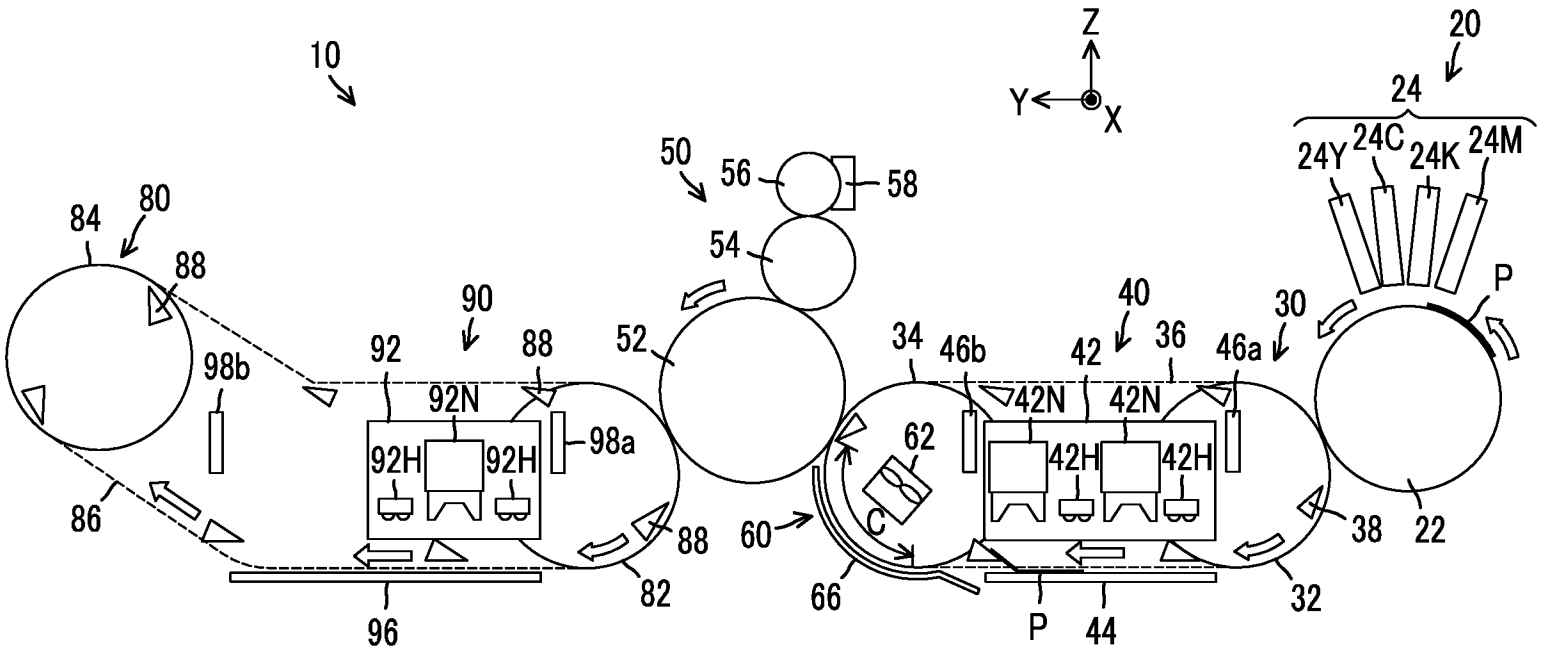
FIG. 1 is a diagram showing the entire structure of an ink jet recording apparatus.

An ink jet recording apparatus 10 (an example of a printing apparatus) is an ink jet printer that records an image on a sheet P (an example of a recording medium) by using aqueous ink. As shown in FIG. 1, the ink jet recording apparatus 10 includes an image recording section 20, a first chain transport section 30, an ink drying-fixing section 40, a varnish application section 50, a varnish pretreatment section 60, a second chain transport section 80, a varnish drying-fixing section 90, and the like.

<Image Recording Section>

The image recording section 20 is image recording means for recording an image by applying aqueous ink to the recording surface of the sheet P, and includes a transport cylinder 22, a head unit 24, and the like.

The transport cylinder 22 is a cylindrical drum that receives a sheet P from a feed section (not shown), transports the received sheet P by rotating while holding the received sheet P on the outer peripheral surface thereof, and delivers the received sheet P to the first chain transport section 30. The transport cylinder 22 is fixed to a rotating shaft (not shown) and is driven so as to rotate about the rotating shaft. Further, the transport cylinder 22 includes claw-shaped grippers (not shown) provided on the outer peripheral surface thereof. The grippers grip the front end of the sheet P at a position where the sheet P is delivered from the feed section, and release the grip of the sheet P at a position where the sheet P is delivered to the first chain transport section 30.

Since a plurality of suction holes (not shown) are formed on the outer peripheral surface of the transport cylinder 22, the sheet P is held on the outer peripheral surface of the transport cylinder 22 through suction by negative pressure generated in the suction holes. The transport cylinder 22 is not limited to a structure that fixes the sheet P by suction using negative pressure, and may hold the sheet P by, for example, electrostatic attraction.

The head unit 24 includes ink jet heads 24M, 24K, 24C, and 24Y that apply aqueous ink having four colors of magenta (M), black (K), cyan (C), and yellow (Y) to the recording surface of the sheet P transported by the transport cylinder 22. The ink jet heads 24M, 24K, 24C, and 24Y are disposed so that the nozzle surface (not shown) of each ink jet head faces the transport cylinder 22, and the nozzle surface is provided with a plurality of nozzles (not shown) that eject aqueous ink. Aqueous ink means ink in which a color material, such as a dye or a pigment, is dissolved or dispersed in water and a solvent soluble in water, and may be simply referred to as ink in the following description.

The image recording section 20 having the above-mentioned structure grips the front end of the sheet P, which is fed from the feed section, by the grippers, holds the sheet P on the outer peripheral surface of the transport cylinder 22, and transports the sheet P by rotating the transport cylinder 22. Each of the ink jet heads 24M, 24K, 24C, and 24Y ejects ink having each color to the sheet P, which is transported to a position where each nozzle surface faces, from the nozzles to record an image on the recording surface of the sheet P (an example for recording an image with ink). After that, the transport cylinder 22 delivers the sheet P, on which the image has been recorded, to the first chain transport section 30.

<First Chain Transport Section>

The first chain transport section 30 (an example of a transport section) is a chain gripper that transports the sheet P, which is received from the image recording section 20, to the varnish application section 50; and includes first sprockets 32, second sprockets 34, chains 36, grippers 38, and the like.

The first sprockets 32 are installed close to the image recording section 20 and the second sprockets 34 are installed close to the varnish application section 50. The first sprockets 32 and the second sprockets 34 are supported by bearings (not shown) so as to be rotatable, and a motor (not shown) is connected to the first sprockets 32.

The chains 36 are formed in an endless shape and are wound around the first and second sprockets 32 and 34. A plurality of chain guides (not shown), which guide the travel of the chains 36, are provided between the first and second sprockets 32 and 34.

Each of the first sprockets 32, the second sprockets 34, the chains 36, and the chain guides make a pair, and are provided on both sides of the sheet P in an X direction orthogonal to a Y direction that is the transport direction of the sheet P.

A plurality of grippers 38 are installed so as to be laid on the chains 36 that make a pair, and are mounted on the chains 36 at regular intervals. The grippers 38 grip the front end of the sheet P at a position where the sheet P is delivered from the transport cylinder 22, and release the grip of the sheet P at a position where the sheet P is delivered to a varnish impression cylinder 52.

When the motor connected to the first sprockets 32 is driven, the first sprockets 32 of the first chain transport section 30 having the above-mentioned structure are rotated clockwise in FIG. 1 and the chains 36 travel. The grippers 38 grip the front end of the sheet P delivered from the transport cylinder 22, transport the sheet P by moving along the travel path of the chains 36, and deliver the sheet P to the varnish impression cylinder 52. Accordingly, the sheet P is transported along a transport path.

<Ink Drying-Fixing Section>

The ink drying-fixing section 40 (an example of a drying section) is heating-fixing means for drying and fixing the ink of the recording surface of the passing sheet P by heating; and includes a heating-drying unit 42, a guide board 44, jam sensors 46*a* and 46*b*, and the like.

The heating-drying unit 42 includes an infrared heater 42H and a hot air knife 42N; and heats air by the infrared heater 42H and blows the heated air to the sheet P by the hot air knife 42N.

The guide board 44 as an example of guide means is disposed at a position that faces the heating-drying unit 42. The guide board 44 is a rectangular plate-like member, and includes a flat sheet-holding surface that holds the sheet P. The size of the sheet-holding surface in the Y direction is larger than that of the heating-drying unit 42, and the size of the sheet-holding surface in the X direction is larger than the width of the sheet P.

The guide board 44 is disposed so that the sheet-holding surface faces the heating-drying unit 42 with a fixed distance between the sheet-holding surface and the chains 36. Since a plurality of suction holes (not shown) are provided on the sheet-holding surface, the sheet P, which is transported by the first chain transport section 30, is sucked on the sheet-holding surface by suction means (not shown), such as a pump communicating with the suction holes.

The jam sensors 46*a* and 46*b* are disposed immediately in front of and in the rear of the heating-drying unit 42 on the transport path of the sheet P, respectively. Since whether or not the sheet P has been transported is detected by the jam sensors 46*a* and 46*b*, the jam of the sheet P in the ink drying-fixing section 40 can be detected.

The ink drying-fixing section 40 having the above-mentioned structure sucks the sheet P, which is transported by the first chain transport section 30, from the back, which is the surface of the sheet P opposite to the recording surface, by the guide board 44, and heats the recording surface of the sheet P by the heating-drying unit 42 to dry and fix the ink of the recording surface.

In a case in which the sheet P detected by the jam sensor 46*a* is not detected by the jam sensor 46*b* after the lapse of a fixed time, it is determined that a jam occurs in the ink drying-fixing section 40. In a case in which the occurrence of a jam is determined, the transport of the sheet P is forcibly stopped and safety-ensuring measures, such as the blocking of the supply of current to a heat source of the heating-drying unit 42, is performed.

<Varnish Application Section>

The varnish application section 50 is varnish applying means for applying varnish (coating liquid) to the recording surface of the sheet P on which the image has been recorded, and includes the varnish impression cylinder 52, a varnish cylinder 54, a varnish supply roller 56, a varnish chamber 58, and the like.

The varnish impression cylinder 52 is a cylindrical drum that receives the sheet P from the first chain transport section 30, transports the sheet P in the Y direction by rotating while holding the received sheet P on the outer peripheral surface thereof, and delivers the sheet P to the second chain transport section 80. The varnish impression cylinder 52 is fixed to a rotating shaft (not shown) and is driven so as to rotate about the rotating shaft. In addition, the varnish impression cylinder 52 includes claw-shaped grippers (not shown) provided on the outer peripheral surface thereof. The grippers grip the front end of the sheet P at a position where the sheet P is delivered from the first chain transport section 30 and release the grip of the sheet P at a position where the sheet P is delivered to the second chain transport section 80.

The varnish cylinder 54 is a varnish applying roller that transfers and applies (coating) the varnish, which is held on the surface thereof, to the recording surface of the sheet P, and a varnish plate (also referred to as a resin plate or a blanket) (not shown) is wound on the outer peripheral surface of the varnish cylinder 54. The varnish supply roller 56 is a measuring roller that supplies a fixed amount of varnish to the surface of the varnish plate of the varnish cylinder 54. The varnish chamber 58 stores varnish and a part of the varnish supply roller 56 is immersed in the varnish so that varnish is supplied to the varnish supply roller 56. The supply of varnish to the varnish chamber 58 is performed by a varnish circulating device (not shown). The kind of varnish is not particularly limited, but aqueous varnish is used here. Aqueous varnish is varnish that contains water and a solvent soluble in water.

In the varnish application section 50 having the above-mentioned structure, varnish is supplied to the varnish supply roller 56 from the varnish chamber 58. Since surplus varnish of the varnish, which is supplied from the varnish chamber 58, is scraped off from the surface of the varnish supply roller 56 by a chamber blade (not shown), a fixed amount of varnish is measured and is uniformly supplied to the varnish supply roller 56. Subsequently, measured varnish is uniformly transferred to the varnish plate of the varnish cylinder 54 from the varnish supply roller 56.

The sheet P, which is delivered to the varnish impression cylinder 52 from the first chain transport section 30, is held on the outer peripheral surface of the varnish impression cylinder 52, is transported in the Y direction (an example of a first direction) as the transport direction by the rotation of the varnish impression cylinder 52, and reaches a contact point (nip point) between the varnish impression cylinder 52 and the varnish cylinder 54.

The varnish plate and the recording surface of the sheet P, which is transported in the Y direction by the varnish impression cylinder 52, come into contact with each other at the nip point and the nip point is sequentially moved in the Y direction in the recording surface of the sheet P, so that the varnish uniformly applied to and held on the varnish plate of the varnish cylinder 54 is uniformly transferred and applied to the recording surface of the sheet P heated by the ink drying-fixing section 40. That is, the varnish application section 50 applies varnish to the recording surface of the heated sheet P in the Y direction. Since varnish is uniformly transferred to the recording surface of the sheet P as described above, the drying and fixing of the varnish of the varnish drying-fixing section 90 are stabilized.

The grippers (not shown), which are provided on the outer peripheral surface of the varnish impression cylinder 52, protrude outward from the outer peripheral surface of the varnish impression cylinder 52. Accordingly, for the avoidance of the collision between the grippers and the varnish cylinder 54, get-on bases (not shown) are provided at end portions of the varnish impression cylinder 52 at positions where the grippers are disposed.

After varnish is uniformly transferred and applied to the recording surface of the sheet P by the varnish cylinder 54, the varnish impression cylinder 52 delivers the sheet P to the second chain transport section 80.

The varnish application section 50 is adapted to be capable of adjusting the contact pressure between the chamber blade of the varnish chamber 58 and the varnish supply roller 56 and/or the nip pressure between the varnish plate of the varnish cylinder 54 and the sheet P that is held on the varnish impression cylinder 52. Further, since the varnish application section 50 is adapted to be capable of adjusting the linear velocity of the surface of the varnish supply roller 56 and the linear velocity of the surface of the varnish plate of the varnish cylinder 54, the varnish application section 50 can also adjust the amount of varnish to be supplied to the sheet P.

Further, since there is also a case in which the pattern of varnish is applied to the recording surface of the sheet P so as to correspond to an image pattern to be recorded on the sheet P, the varnish is called spot varnish. Since the spot varnish needs to be aligned with the recorded image, the varnish application section 50 has a function to move the varnish plate wound on the varnish cylinder 54 to align the spot varnish. The movement of the varnish plate, that is, the adjustment of the position of the varnish plate in the Y direction (top-bottom adjustment) and the adjustment of the position of the varnish plate in the X direction (left-right adjustment) are performed by the adjustment of the meshing of the varnish cylinder 54 and gears (not shown). Furthermore, oblique adjustment is performed by the oblique attachment (winding) of the varnish plate or oblique delivery of the sheet P to the varnish impression cylinder 52.

<Varnish Pretreatment Section>

The varnish pretreatment section 60 is pretreatment means for adjusting the temperature of the recording surface until varnish is applied to the recording surface after the image is recorded on the recording surface of the sheet P; and includes a blower unit 62, a guide board 66, and the like.

The blower unit 62 (an example of a blowing unit) includes an electric fan (not shown) that supplies blowing air having environmental temperature to the recording surface of the sheet P transported by the first chain transport section 30. The blower unit 62 always supplies blowing air by the electric fan regardless of whether or not the sheet P has been transported by the first chain transport section 30. Blowing air supplied from the blower unit 62 may be supplied to the sheet P only in a case in which the sheet P passes through a position that faces the blower unit 62.

The guide board 66 is disposed at the position that faces the blower unit 62. The guide board 66 includes a guide surface that guides the sheet P, which is transported by the first chain transport section 30, from the back.

The transport path of the sheet P transported by the first chain transport section 30 includes a segment C which is provided on the second sprockets 34 and in which the back of the sheet P is curved in a concave shape toward the outer peripheral surface of the varnish impression cylinder 52. The guide surface of the guide board 66 is provided so as to be curved along the segment C that is curved so as to be concave.

A plurality of vent holes (not shown), which allow blowing air supplied from the blower unit 62 to pass therethrough, are formed so as to pass through the guide board 66. Even in a case in which the sheet P is not present on the guide board 66, blowing air supplied from the blower unit 62 can be passed to the opposite side of the guide board 66 through the vent holes. Accordingly, it is possible to prevent blowing air from staying on the guide surface side of the guide board 66. The vent holes may be provided at a position that faces at least the blower unit 62.

Further, a duct (not shown) is provided on the surface side opposite to the guide surface of the guide board 66. Blowing air supplied from the blower unit 62 passes through the guide board 66 through the vent holes (not shown) and flows into the duct (not shown). Gas flowed into the duct is discharged to the outside of the ink jet recording apparatus 10 through the duct.

Further, there is a possibility that the back of the sheet P and the guide board 66 may come into contact with each other due to the blowing air of the blower unit 62 and the back of the sheet P may be damaged. Rollers (not shown), which rotate about the X direction as an axis, may be provided in parallel in the vent holes in order to avoid a damage to the back of the sheet P. Accordingly, even though the sheet P is pressed against the guide board 66 by the blowing air, the sheet P is smoothly transported by the rotation of the rollers that is caused by the transport of the sheet P. Therefore, it is possible to prevent the back of the sheet P from being damaged.

Here, the blower unit 62 has been provided so as to face the guide board 66, but the blower unit 62 may be disposed on one side of the guide board 66 in the X direction and may supply blowing air from the side in the X direction. In this case, a duct (not shown) may be provided on the other side of the guide board 66 in the X direction.

Since the varnish pretreatment section 60 having the above-mentioned structure guides the sheet P, which is transported by the first chain transport section 30, from the back of the recording surface by the guide board 66 and supplies the flow of air to the recording surface of the sheet P by the blower unit 62, the recording surface of the sheet P can be cooled and the temperature of the recording surface can be adjusted to temperature that is appropriate for the application of varnish.

Here, for the adjustment of the temperature of the recording surface of the sheet P, blowing air having environmental temperature has been blown from the blower unit 62 to cool the recording surface of the sheet P. However, cold air having a temperature lower than environmental temperature may be supplied to the recording surface of the sheet P. Further, in order to raise the temperature of the recording surface, hot air having a temperature higher than environmental temperature may be supplied to the recording surface of the sheet P and/or a heater may be built in the guide board 66 and the sheet P may be heated from the back of the sheet P by the heater.

<Second Chain Transport Section>

The second chain transport section 80 is a chain gripper that transports the sheet P, which is received from the varnish application section 50, to a sheet discharge section (not shown); and includes first sprockets 82, second sprockets 84, chains 86, grippers 88, and the like.

The first sprockets 82 are installed close to the varnish application section 50, and the second sprockets 84 are installed close to the sheet discharge section (not shown). The first sprockets 82 and the second sprockets 84 are supported by bearings (not shown) so as to be rotatable, and a motor (not shown) is connected to the first sprockets 82.

The chains 86 are formed in an endless shape, and are wound around the first and second sprockets 82 and 84. A plurality of chain guides (not shown), which guide the travel of the chains 86, are provided between the first and second sprockets 82 and 84.

Each of the first sprockets 82, the second sprockets 84, the chains 86, and the chain guides make a pair, and are provided on both sides of the sheet P in a direction orthogonal to the transport direction of the sheet P.

A plurality of grippers 88 are installed so as to be laid on the chains 86 that make a pair, and are mounted on the chains 86 at regular intervals. The grippers 88 grip the front end of the sheet P at a position where the sheet P is delivered from the varnish impression cylinder 52, and release the grip of the sheet P at a position where the sheet P is delivered to the sheet discharge section (not shown).

When the motor (not shown) connected to the first sprockets 82 is driven, the first sprockets 82 of the second chain transport section 80 having the above-mentioned structure are rotated clockwise in FIG. 1 and the chains 86 travel. The grippers 88 grip the front end of the sheet P delivered from the varnish impression cylinder 52, transport the sheet P by moving along the travel path of the chains 86, and deliver the sheet P to the sheet discharge section (not shown).

<Varnish Drying-Fixing Section>

The varnish drying-fixing section 90 is varnish drying-fixing means for drying and fixing the varnish of the recording surface of the passing sheet P; and includes a heating-drying unit 92, a guide board 96, jam sensors 98*a* and 98*b*, and the like.

The heating-drying unit 92 includes an infrared heater 92H and a hot air knife 92N; and heats air by the infrared heater 92H and blows the heated air to the sheet P by the hot air knife 92N. The heating-drying unit 92 is adapted to be capable of adjusting the output intensity thereof.

The guide board 96 is disposed at a position that faces the heating-drying unit 92. The guide board 96 is a rectangular plate-like member. The size of the guide board 96 in the Y direction is larger than that of the heating-drying unit 92 and the size of the guide board 96 in the X direction is larger than the width of the sheet P.

Further, the guide board 96 includes a flat sheet-holding surface holding the sheet P, and is disposed so that the sheet-holding surface faces the heating-drying unit 92 with a fixed distance between the sheet-holding surface and the chains 86. Since a plurality of suction holes (not shown) are provided on the sheet-holding surface, the sheet P, which is transported by the second chain transport section 80, is sucked on the sheet-holding surface.

The jam sensors 98*a* and 98*b* are disposed immediately in front of and in the rear of the heating-drying unit 92 on the transport path of the sheet P, respectively. Since whether or not the sheet P has been transported is detected by the jam sensors 98*a* and 98*b*, the jam of the sheet P in the varnish drying-fixing section 90 can be detected.

The varnish drying-fixing section 90 having the above-mentioned structure sucks the sheet P, which is transported by the second chain transport section 80, from the back of the recording surface by the guide board 96, and heats the recording surface of the sheet P by the heating-drying unit 92 to dry and fix the varnish of the recording surface. The output intensity of the heating-drying unit 92 may be appropriately adjusted to an appropriate value.

Further, in a case in which the sheet P detected by the jam sensor 98*a* is not detected by the jam sensor 98*b* after the lapse of a fixed time, it is determined that the jam of the sheet P occurs in the varnish drying-fixing section 90. In a case in which the occurrence of a jam is determined, the transport of the sheet P is forcibly stopped and safety-ensuring measures, such as the blocking of the supply of current to the infrared heater 92H and the hot air knife 92N, is performed.

After that, the sheet P, which has passed through the varnish drying-fixing section 90, is sent to the sheet discharge section (not shown) by the second chain transport section 80. The sheet discharge section, which recovers the sheet P, stacks the sheet P.

A cooling device, which sends air to the passing sheet P to cool the sheet P, may be disposed between the heating-drying unit 92 and the sheet discharge section (not shown) on the transport path of the sheet P of the second chain transport section 80. Further, a cooling device, which sends air to a stacking unit having stacked sheets P and makes air pass between the stacked sheets to cool the sheets, may be disposed in the sheet discharge section.

[System Configuration of Ink Jet Recording Apparatus]

Figure 2:
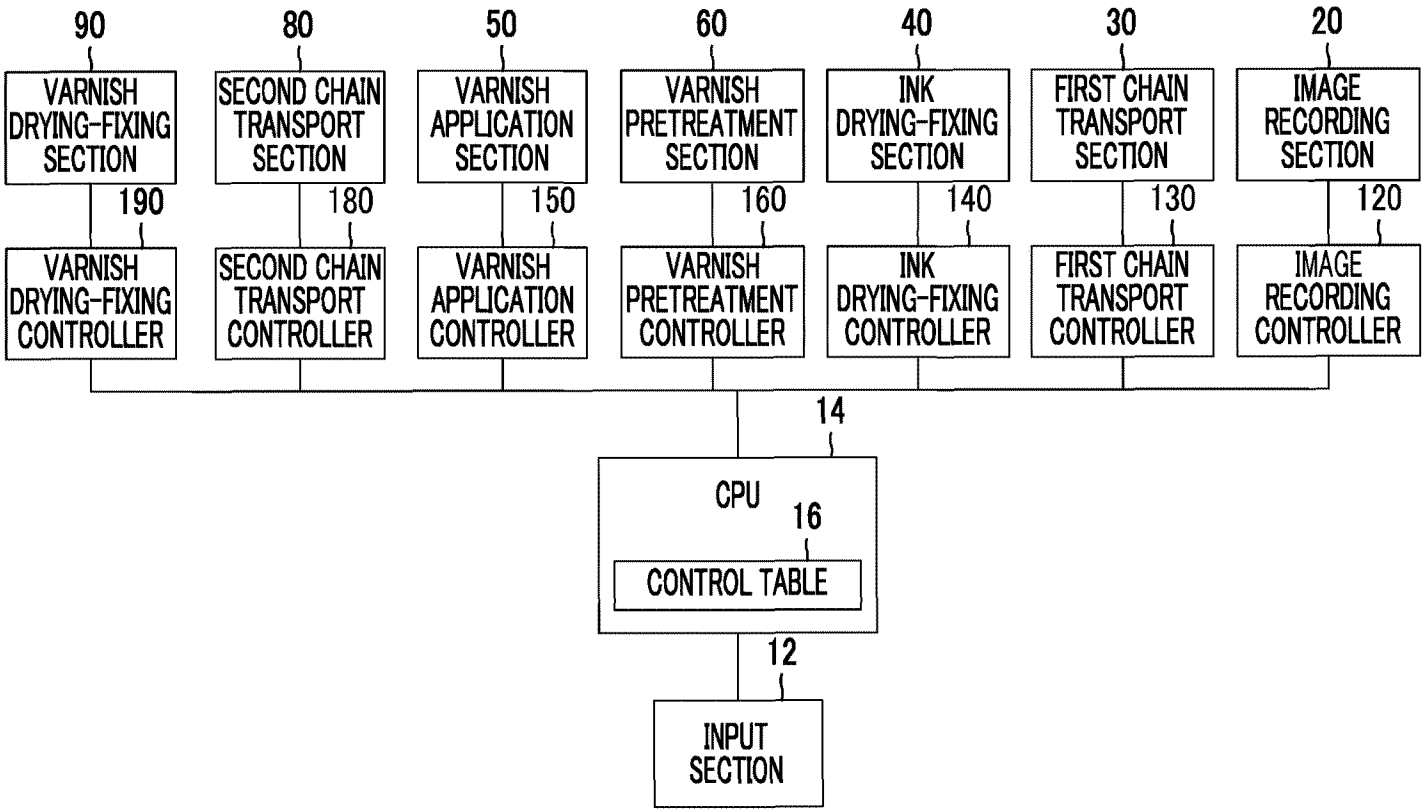
FIG. 2 is a block diagram showing the system configuration of the ink jet recording apparatus.

FIG. 2 is a block diagram showing the system configuration of the ink jet recording apparatus 10. The ink jet recording apparatus 10 includes an input section 12, a central processing unit (CPU) 14, an image recording controller 120, a first chain transport controller 130, an ink drying-fixing controller 140, a varnish application controller 150, a varnish pretreatment controller 160, a second chain transport controller 180, and a varnish drying-fixing controller 190 in addition to the image recording section 20, the first chain transport section 30, the ink drying-fixing section 40, the varnish application section 50, the varnish pretreatment section 60, the second chain transport section 80, and the varnish drying-fixing section 90.

The input section 12 is a user interface that is used by a user to input image data and the like, which is to be printed, to the ink jet recording apparatus 10.

The CPU 14 is control means for generally controlling the respective sections of the ink jet recording apparatus 10 according to an input from the input section 12. The CPU 14 includes a control table 16 that is stored in a storage section (not shown). The details of the control table 16 will be described below.

The image recording controller 120 controls the image recording section 20 according to a control signal, which is sent from the CPU 14, to transport the sheet P by the transport cylinder 22 and to record an image on the recording surface of the sheet P by the ink jet heads 24M, 24K, 24C, and 24Y.

The first chain transport controller 130 controls the first chain transport section 30 according to a control signal, which is sent from the CPU 14, to rotate the first sprockets 32 by the motor (not shown), to make the chains 36 travel, and to transport the sheet P that is gripped by the grippers 38.

The ink drying-fixing controller 140 controls the ink drying-fixing section 40 according to a control signal, which is sent from the CPU 14, to suck the sheet P on the guide board 44 by the suction means (not shown), to heat the recording surface of the sheet P by the heating-drying unit 42, and to dry and fix the ink of the recording surface. Further, the ink drying-fixing controller 140 detects the occurrence of a jam by the jam sensors 46*a* and 46*b*.

The varnish application controller 150 controls the varnish application section 50 according to a control signal, which is sent from the CPU 14, to apply varnish to the recording surface of the sheet P in the first direction.

The varnish pretreatment controller 160 controls the varnish pretreatment section 60 according to a control signal, which is sent from the CPU 14, to supply the flow of air to the recording surface of the sheet P by the blower unit 62.

The second chain transport controller 180 controls the second chain transport section 80 according to a control signal, which is sent from the CPU 14, to rotate the first sprockets 82 by the motor (not shown), to make the chains 86 travel, and to transport the sheet P that is gripped by the grippers 88.

The varnish drying-fixing controller 190 controls the varnish drying-fixing section 90 according to a control signal, which is sent from the CPU 14, to suck the sheet P on the guide board 96 by the suction means (not shown) and to heat the recording surface of the sheet P by the heating-drying unit 92. The varnish drying-fixing controller 190 makes the varnish of the recording surface be dried and fixed. Further, the varnish drying-fixing controller 190 detects the occurrence of a jam by the jam sensors 98*a* and 98*b*.

The image recording controller 120, the first chain transport controller 130, the ink drying-fixing controller 140, the varnish application controller 150, the varnish pretreatment controller 160, the second chain transport controller 180, and the varnish drying-fixing controller 190 may be formed of the CPU 14 or one or a plurality of CPUs different from the CPU 14, and may be operated by reading and executing programs that are stored in a storage section (not shown).

A difference occurs between glossiness Gy in the Y direction and glossiness Gx in the X direction, which are obtained after varnish is dried, on the sheet P on which an image has been printed by the ink jet recording apparatus 10 that performs the recording of an image and the application of varnish in an in-line manner. As a result of the earnest investigation, the inventor found that this difference in glossiness is related to the temperature of the recording surface at the time of application of varnish and the physical property of varnish.

[Coating Formation Time of Varnish]

In this embodiment, coating formation time of varnish is used as an index representing the physical property of varnish. Coating formation time tw of varnish is defined as time that has passed until wrinkles are formed on varnish present in a plastic vessel which includes a flat bottom having a diameter of 60 mm and in which 5 g of varnish is put when the vessel is horizontally placed on a hot plate having a temperature of 80° C. and is then inclined at an angle of 45° with respect to the horizon. Here, the wrinkle means a concave shape that can be formed on the surface of varnish due to the flow of varnish, of which the viscosity has risen due to heat applied from the hot plate, caused by the inclination of a cup.

Figure 3:
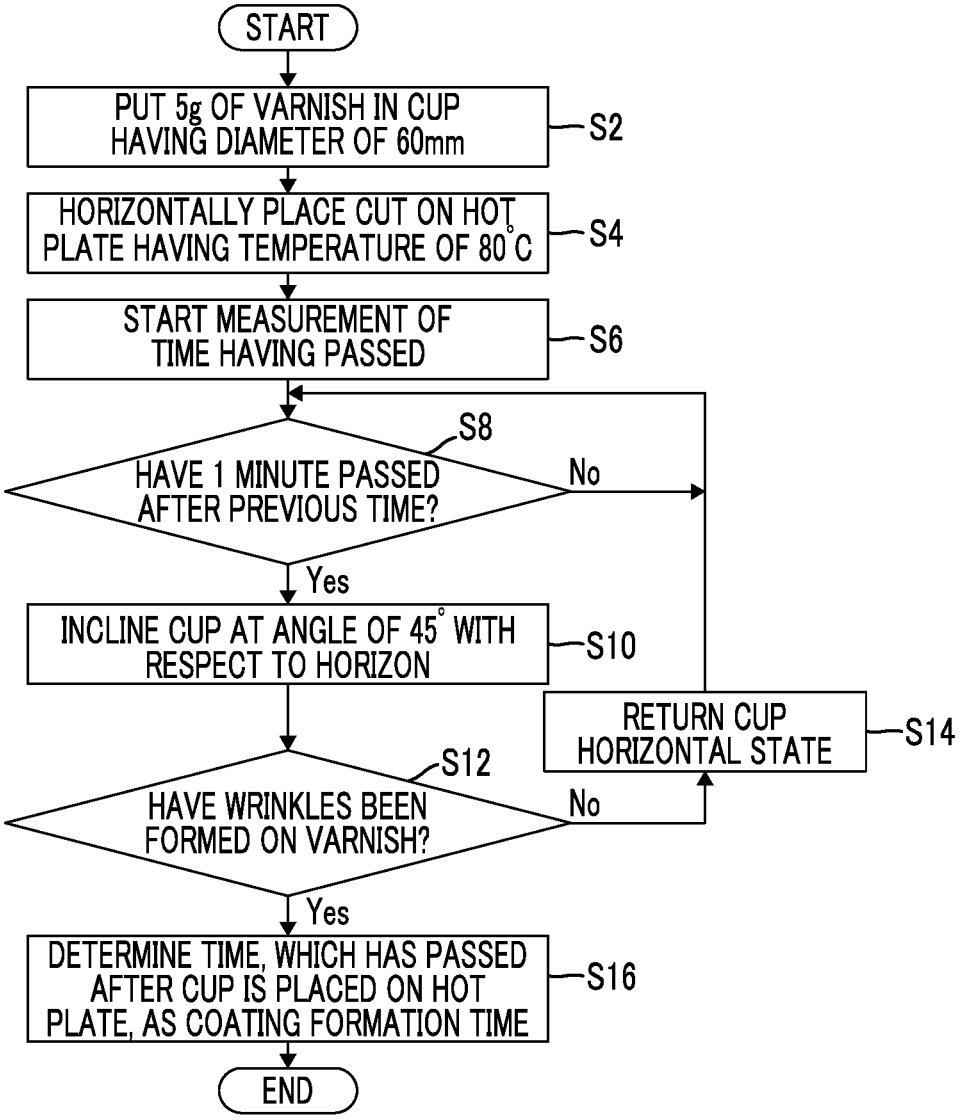
FIG. 3 is a flow chart illustrating processing for determining coating formation time tw of varnish.

A method of measuring the coating formation time tw of varnish will be described with reference to a flow chart illustrated in FIG. 3.

First, 5 g of varnish of which coating formation time is to be measured is put in a plastic cup (an example of the vessel) (Step S2). The bottom of the cup is a flat bottom having a diameter of 60 mm.

Next, the cup is horizontally placed on a hot plate heated to a temperature of 80° C. (Step S4), and the measurement of time, which has passed after the cup is placed on the hot plate, is started (Step S6).

Subsequently, whether or not 1 minute has passed after the cup is placed on the hot plate is determined (Step S8). If 1 minute has not passed, the determination processing of Step S8 is performed continuously.

If 1 minute has passed, processing proceeds to Step S10 and the cup is inclined at an angle of 45° with respect to the horizon (Step S10). Then, whether or not wrinkles have been formed on the varnish present in the cup is determined (Step S12).

If wrinkles have not been formed, the cup returns to a horizontal state (Step S14) and processing returns to the processing of Step S8. Time, which has passed until the cup is inclined and returns to a horizontal state, is set to about one second.

In Step S8, whether or not 1 minute has passed after the cup is inclined is determined. If 1 minute has passed, processing proceeds to Step S10. That is, the cup is inclined every one minute and whether or not wrinkles have been formed on the varnish is determined.

If wrinkles have been formed, time, which has passed until wrinkles are formed on the varnish after the cup is placed on the hot plate, is determined as the coating formation time tw of varnish (Step S16) and the processing of this flow chart ends. The unit of the coating formation time tw is minute.

The coating formation time tw of varnish to be used is acquired in advance as described above.

[Relationship Between Coating Formation Time of Varnish and Temperature of Surface of Sheet at the Time of Application of Varnish]

Subsequently, a relationship between the coating formation time of varnish, the temperature of the surface of a sheet at the time of application of the varnish, and a gloss difference was examined.

First, the varnish was applied to the recording surface of a sheet P by the ink jet recording apparatus 10. Further, the temperature of the recording surface at the time of application of varnish was acquired.

Figure 4:
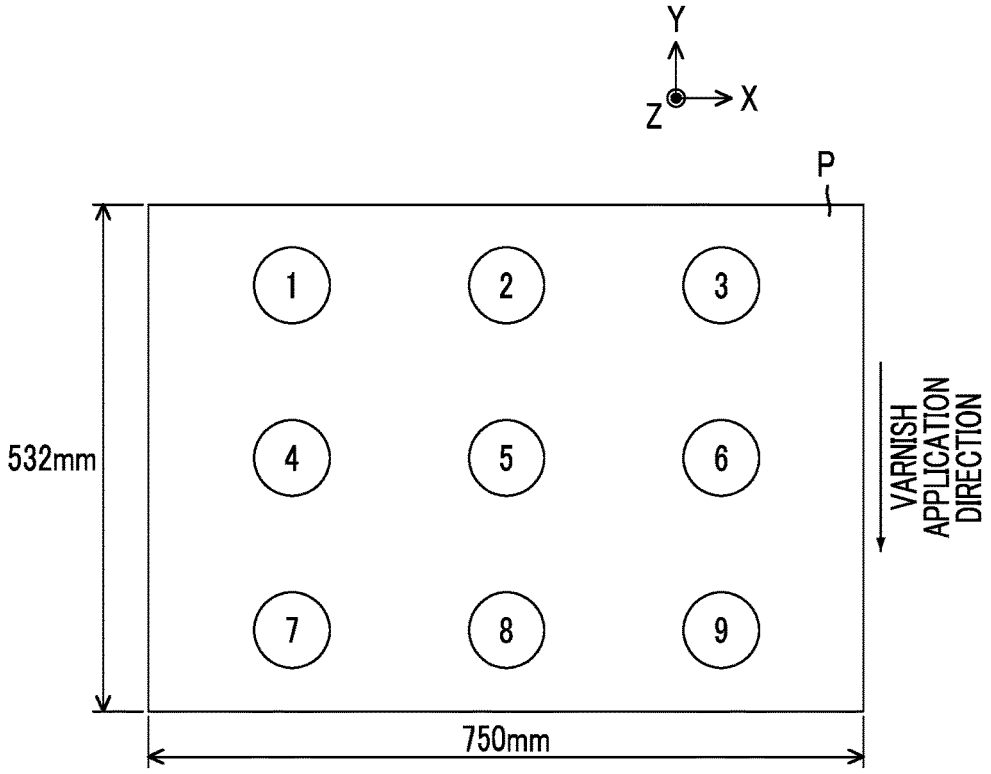
FIG. 4 is a diagram showing positions at which the glossiness of a sheet to which varnish is applied is measured.

After that, glossiness was measured after the drying of the varnish. The measurement of glossiness was performed at an incident angle/reflection angle of 60° using a gloss meter (micro-TRI gloss manufactured by BYK Gardner) on the basis of Japanese Industrial Standards (JIS) Z 8741. The value of glossiness was larger as gloss is higher, and the unit of glossiness was dimensionless. Here, as shown in FIG. 4, varnish was applied to a sheet P having a size of 532 mm in the Y direction as the transport direction and a size of 750 mm in the X direction, and glossiness Gx in the X direction and glossiness Gy in the Y direction were measured at each of nine positions on the sheet P. In addition, a gloss difference "ΔG=Gy−Gx", which is a difference between the glossiness Gy in the Y direction and the glossiness Gx in the X direction at each position, was calculated, and an average of the gloss differences ΔG obtained at the nine positions was referred to as a gloss difference ΔG in the combination of the varnish and the temperature of the recording surface at the time of application of the varnish.

The varnish application section 50 has a relationship of "Gy>Gx" to apply varnish to the recording surface of the sheet P in the Y direction. Accordingly, the gloss difference ΔG has a positive value. |ΔG|, which is the absolute value of the gloss difference ΔG, may be used instead of the gloss difference ΔG in the following description.

Figure 5:
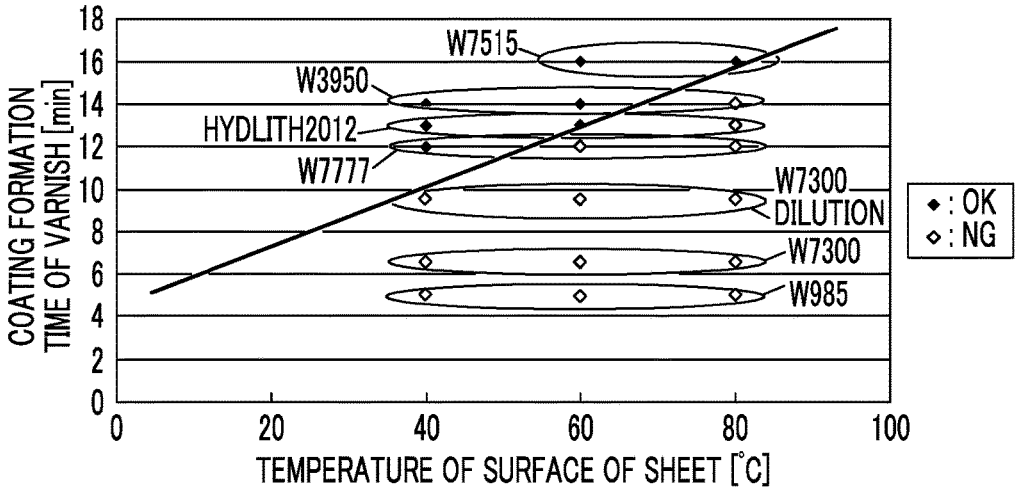
FIG. 5 is a graph in which a relationship between the temperature of the recording surface of a sheet P at the time of application of varnish and coating formation time of the varnish is plotted.
Figure 6:
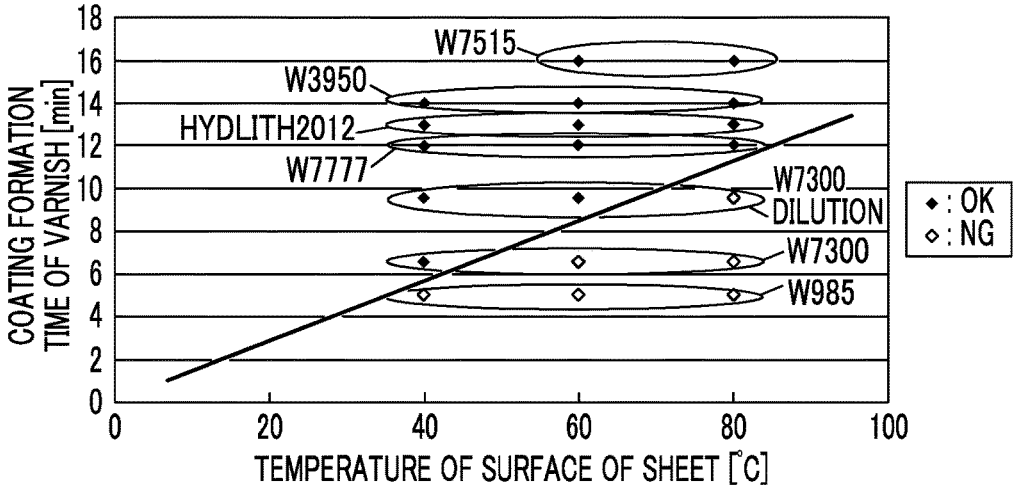
FIG. 6 is a graph in which a relationship between the temperature of the recording surface of a sheet P at the time of application of varnish and coating formation time of the varnish is plotted.

FIGS. 5 and 6 are graphs in which a relationship between the temperature of the recording surface of the sheet P at the time of application of varnish and coating formation time of the varnish is plotted for the respective kinds of varnish. A horizontal axis of each of FIGS. 5 and 6 represents the temperature of the recording surface of the sheet P at the time of application of varnish that has ° C. as the unit thereof, and a vertical axis of each of FIGS. 5 and 6 represents the coating formation time of the varnish that has minute as the unit thereof. Further, a case in which an allowable value representing a gloss difference allowed for a printed matter is satisfied is denoted by a black mark, and a case in which an allowable value representing a gloss difference allowed as a printed matter is not satisfied is denoted by a void mark. The allowable value in FIG. 5 is 0, and the allowable value in FIG. 6 is 5.

All of W7515, W3950, W7777, W7300, and W985 shown in FIGS. 5 and 6 were aqueous varnishes manufactured by Hi-Tech Coatings International Limited, and the coating formation time thereof, which was obtained as an average of values obtained from two times of measurement, were 16 minutes, 14 minutes, 12, minutes, 6.5 minutes, and 5 minutes, respectively. W7300 dilution is a dilution that is obtained by adding water, which corresponds to 20 mass % of W7300, to W7300, and the coating formation time thereof, which was obtained as an average of values obtained from two times of measurement, was 9.5 minutes. Further, HYDLITH2012 was aqueous varnish manufactured by DIC Graphics Corporation, and the coating formation time thereof, which was obtained as an average of values obtained from two times of measurement, was 13 minutes.

In a case in which the allowable value is 0, as shown in FIG. 5, the temperature of the recording surface of the sheet P does not satisfy the allowable value at 40° C., 60° C., and 80° C. in regard to W985 of which the coating formation time is 5 minutes, W7300 of which the coating formation time is 7 minutes, and W7300 dilution of which the coating formation time is 9 minutes. The temperature of the recording surface of the sheet P does not satisfy the allowable value at 60° C. and 80° C. but satisfies the allowable value at 40° C. in regard to W7777 of which the coating formation time is 12 minutes.

Further, the temperature of the recording surface of the sheet P does not satisfy the allowable value at 80° C. but satisfies the allowable value at 40° C. and 60° C. in regard to HYDLITH2012 and W3950 of which the coating formation time is 13 minutes. Furthermore, it is thought that the temperature of the recording surface of the sheet P satisfies the allowable value at 60° C. and 80° C. and also satisfies the allowable value at 40° C. in regard to W7515 of which the coating formation time is 16 minutes.

On the other hand, in a case in which the allowable value is 5, as shown in FIG. 6, the temperature of the recording surface of the sheet P does not satisfy the allowable value at 40° C., 60° C., and 80° C. in regard to W985. The temperature of the recording surface of the sheet P does not satisfy the allowable value at 60° C. and 80° C. but satisfies the allowable value at 40° C. in regard to W7300. The temperature of the recording surface of the sheet P does not satisfy the allowable value at 80° C. but satisfies the allowable value at 40° C. and 60° C. in regard to W7300 dilution.

Further, the temperature of the recording surface of the sheet P satisfies the allowable value at 40° C., 60° C., and 80° C. in regard to W7777, HYDLITH2012, and W3950. Furthermore, the temperature of the recording surface of the sheet P satisfies the allowable value at 60° C. and 80° C. and also satisfies the allowable value at 40° C. in regard to W7515.

Straight lines, which represent a boundary between a case in which the allowable value is satisfied and a case in which the allowable value is not satisfied, are shown in FIGS. 5 and 6. Expression 1 can be derived from these straight lines. That is, when the temperature of the recording surface at the time of application of varnish is denoted by Tp, the coating formation time of the varnish is denoted by tw, and a constant determined according to the allowable value of a gloss difference, which is a difference between the glossiness of the recording surface of which the applied varnish has been dried in the Y direction and the glossiness of the recording surface in the X direction, is denoted by a, it is possible to satisfy the allowable value by satisfying Expression 1. The unit of Tp is ° C. and the unit of tw is minute.

$$Tp-(40/6)\times tw\leq a \quad \text{(Expression 1)}$$

Further, when the allowable value is denoted by Gp, the constant a, which is the right-hand side of Expression 1, is expressed as in Expression 2.

$$a=5.2\times Gp-26 \quad \text{(Expression 2)}$$

Accordingly, the value of the constant a is −26 in a case in which the allowable value Gp is 0, is 0 in a case in which the allowable value Gp is 5, and is 26 in a case in which the allowable value Gp is 10.

[Control of Temperature of Recording Surface in Varnish Pretreatment Section]

Subsequently, a printing method of the ink jet recording apparatus 10 will be described with reference to a flow chart illustrated in FIG. 7. The varnish pretreatment section 60 is made to operate in this embodiment so that Expression 1 is satisfied.

Conditions of the varnish pretreatment section 60 are set before the start of printing. In regard to the setting of the conditions of the varnish pretreatment section 60, first, a user inputs the allowable value Gp of a gloss difference, which is allowed for a printed matter, to the CPU 14 (an example of an acquisition section) by using the input section 12 in Step S22. Here, the allowable value Gp of a gloss difference is 0. A user may be made to input the constant a.

Next, the CPU 14 selects varnish, which is to be used, from the control table 16 in Step S24. FIG. 8 is a diagram showing an example of the control table 16 in a case in which the allowable value is 0. The kinds of varnish, which can be used, and the upper limits of the temperature Tp of the recording surface of the sheet P, which are required to satisfy the allowable value in a case in which the varnish is used, are stored in the control table 16 in association with each other. That is, the upper limit of the temperature Tp is the maximum value of the temperature Tp that is obtained when the coating formation time tw of each varnish and the allowable value Gp are input to Expression 1 and Expression 2.

Figures 7, 8:
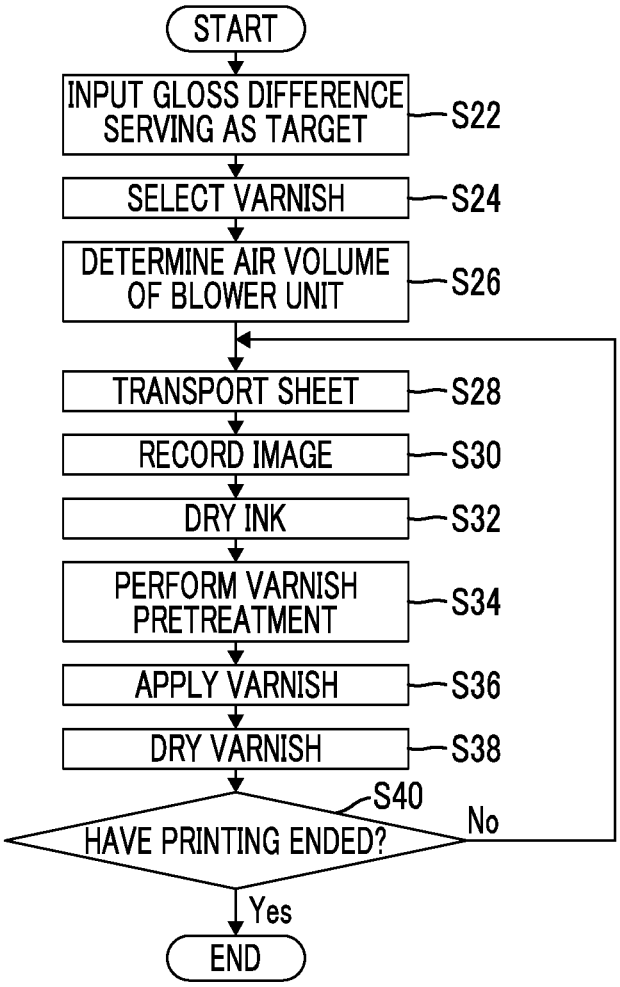
FIG. 7 is a flow chart illustrating the processing of a printing method of the ink jet recording apparatus.
FIG. 8 is a diagram showing an example of a control table.

Four kinds of varnishes, that is, W7515, W3950, HYDLITH2012, and W7777 are prepared in the example shown in FIG. 8, and the varnish of W3950 is selected here. Varnishes, which can be selected, may be displayed in a display unit (not shown), and a user may select varnishes from the displayed varnishes.

Subsequently, in Step S26, the CPU 14 (an example of a calculation section) acquires the upper limit of the temperature Tp, which is required to satisfy the allowable value, from the control table 16 in regard to the varnish selected in Step S24 and determines the air volume of the blower unit 62 that is required to make the temperature Tp of the recording surface at the time of application of the varnish be equal to or lower than the acquired upper limit. As shown in FIG. 8, the upper limit of the temperature Tp of the recording surface, which is obtained in a case in which the varnish of W3950 is used, is 60° C.

The blower unit 62 is adapted to be capable of adjusting air volume by changing the number of rotation of the electric fan (not shown) per unit time. The CPU 14 determines the number of rotation of the electric fan (not shown) so that the temperature Tp of the recording surface is equal to or lower than the acquired upper limit of the temperature Tp. A table showing a relationship between the number of rotation of the electric fan (not shown) per unit time and the temperature Tp of the recording surface, which is obtained in a case in which a recording medium transported at the transport speed of the first chain transport section 30 and heated by the heating-drying unit 42 is cooled with the number of rotation of the electric fan, may be used. Further, the blower unit 62 may be provided with a plurality of electric fans and may adjust air volume by changing the number of the electric fans to be driven.

The setting of the conditions of the varnish pretreatment section 60 ends as described above. Subsequently, printing is started.

In regard to printing, first, the image recording controller 120, the first chain transport controller 130, the varnish application controller 150, and the second chain transport controller 180 start the transport of the sheet P in Step S28. The transport cylinder 22, the first chain transport section 30, the varnish impression cylinder 52, and the second chain transport section 80 sequentially transport the sheet P as described above.

Subsequently, in Step S30 (an example of a recording step), the image recording controller 120 ejects ink to the recording surface of the sheet P, which is transported by being rotated while being held on the outer peripheral surface of the transport cylinder 22, from the head unit 24 to record images on the recording surface of the sheet P.

After that, the sheet P is delivered to the first chain transport section 30, and the ink drying-fixing controller 140 dries and fixes the ink of the recording surface of the sheet by the ink drying-fixing section 40 in Step S32 (an example of a drying step).

Subsequently, in Step S34, the varnish pretreatment controller 160 (an example of a controller) cools the sheet P with air volume that is set in Step S26 from the blower unit 62 of the varnish pretreatment section 60. Accordingly, in Step S32, the sheet P is cooled so that the temperature of the recording surface of the sheet P heated by the ink drying-fixing section 40 is equal to or lower than the upper limit of the temperature Tp acquired from the control table 16. Here, the sheet P is cooled so that the temperature Tp of the recording surface is 60° C. or less.

After that, the sheet P is delivered to the varnish impression cylinder 52, and the varnish application controller 150 applies varnish to the recording surface of the sheet P, of which the temperature Tp of the recording surface is equal to or lower than 60° C., in the Y direction by the varnish application section 50 in Step S36 (an example of a varnish applying step).

The sheet P to which varnish has been applied is delivered to the second chain transport section 80, and the varnish drying-fixing controller 190 dries the varnish, which is applied to the sheet P, by the varnish drying-fixing section 90 in Step S38.

In Step S40, the CPU 14 determines whether or not all printing has ended. If all printing has ended, the processing of this flow chart ends. In a case in which printing is to be continuously performed, processing returns to Step S28 and the same processing as described above is repeated.

According to this embodiment, since the upper limit of the temperature Tp of the recording surface, which corresponds to the acquired allowable value Gp and the varnish, is acquired and the recording surface is cooled with air volume that makes the temperature Tp of the recording surface be equal to or lower than the acquired upper limit of the temperature Tp, a relationship between the temperature Tp of the recording surface at the time of application of varnish, the coating formation time tw of the varnish, and the constant a determined according to the allowable value Gp can satisfy Expression 1. Accordingly, since it is possible to reduce a difference in glossiness in the in-plane direction of a printed matter on which varnish has been dried, a gloss difference ΔG, which is a difference between the glossiness Gy in the Y direction and the glossiness Gx in the X direction, can satisfy the allowable value Gp.

Second Embodiment

Figure 9:
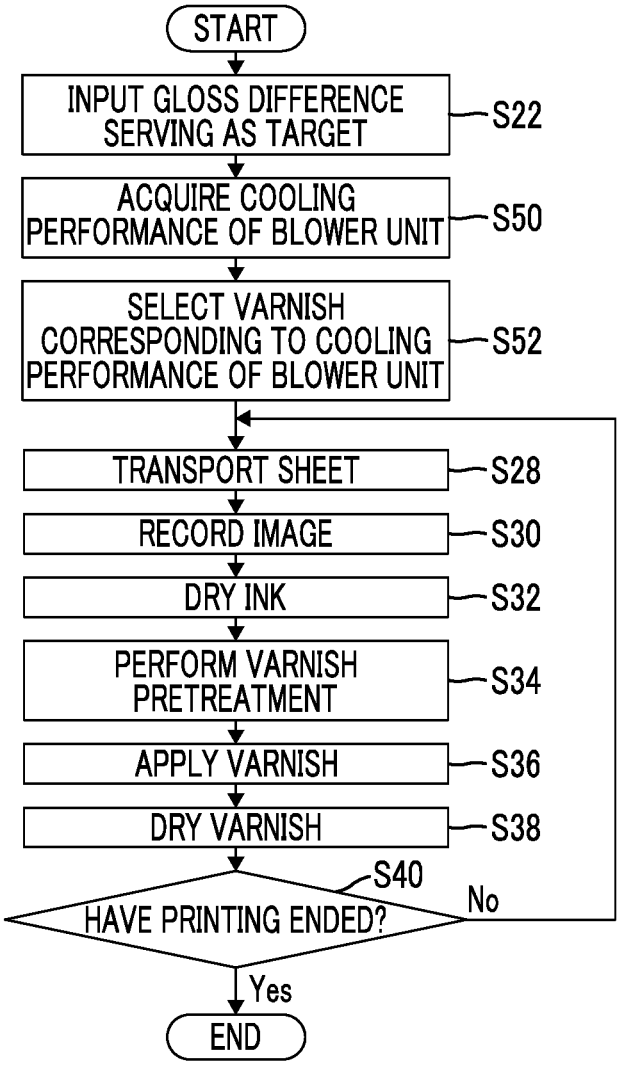
FIG. 9 is a flow chart illustrating the processing of a printing method of the ink jet recording apparatus.

FIG. 9 is a flow chart illustrating the processing of a printing method according to a second embodiment. Portions of FIG. 9, which are common to the flow chart illustrated in FIG. 7, are denoted by the same reference numerals as those of FIG. 7, and the detailed description thereof will be omitted. In this embodiment, varnish is selected so that Expression 1 is satisfied.

As in the first embodiment, first, a user inputs the allowable value of a gloss difference of a printed matter to the CPU 14 (an example of an acquisition section) by using the input section 12 in Step S22. Here, the allowable value is 0.

Next, the CPU 14 acquires the air volume of the blower unit 62 in Step S50.

Subsequently, the CPU 14 (an example of a calculation section, an example of a selection section) calculates the temperature Tp of the recording surface of a sheet P at the time of application of varnish, which is determined from the air volume of the blower unit 62, in Step S52. Then, the CPU 14 selects varnish, of which the upper limit of the temperature Tp is equal to or lower than the temperature Tp, from the control table 16. That is, the CPU 14 selects varnish having coating formation time tw equal to or longer than the lower limit of coating formation time tw that is obtained when the allowable value Gp and the temperature Tp are input to Expression 1 and Expression 2. For example, when the temperature Tp is 50° C., the CPU 14 can select varnish of W7777 of which the upper limit of the temperature Tp is 40° C.

The CPU 14 may acquire the temperature Tp by actually measuring the temperature of the recording surface that is cooled by the blower unit 62 at the time of application of varnish without calculating the temperature Tp from the air volume of the blower unit 62.

Processing subsequent to Step S28 is the same as that of the first embodiment. In Step S36, the varnish application section 50 applies the varnish, which is selected in Step S52, to the recording surface of the sheet P.

According to this embodiment, since the temperature Tp of the recording surface of the sheet P at the time of application of the varnish, which is determined from the air volume of the blower unit 62, is acquired and varnish, which can satisfy the allowable value Gp at a temperature equal to lower than the acquired temperature Tp of the recording surface, is selected, varnish of which the coating formation time is long can be selected and a relationship between the temperature Tp of the recording surface at the time of application of the varnish, the coating formation time tw of the varnish, and the constant a determined according to the allowable value Gp can satisfy Expression 1. Accordingly, since it is possible to reduce a difference in glossiness in the in-plane direction of a printed matter on which varnish has been dried, a gloss difference ΔG, which is a difference between the glossiness Gy in the Y direction and the glossiness Gx in the X direction, can satisfy the allowable value Gp.

Third Embodiment

Figure 10:
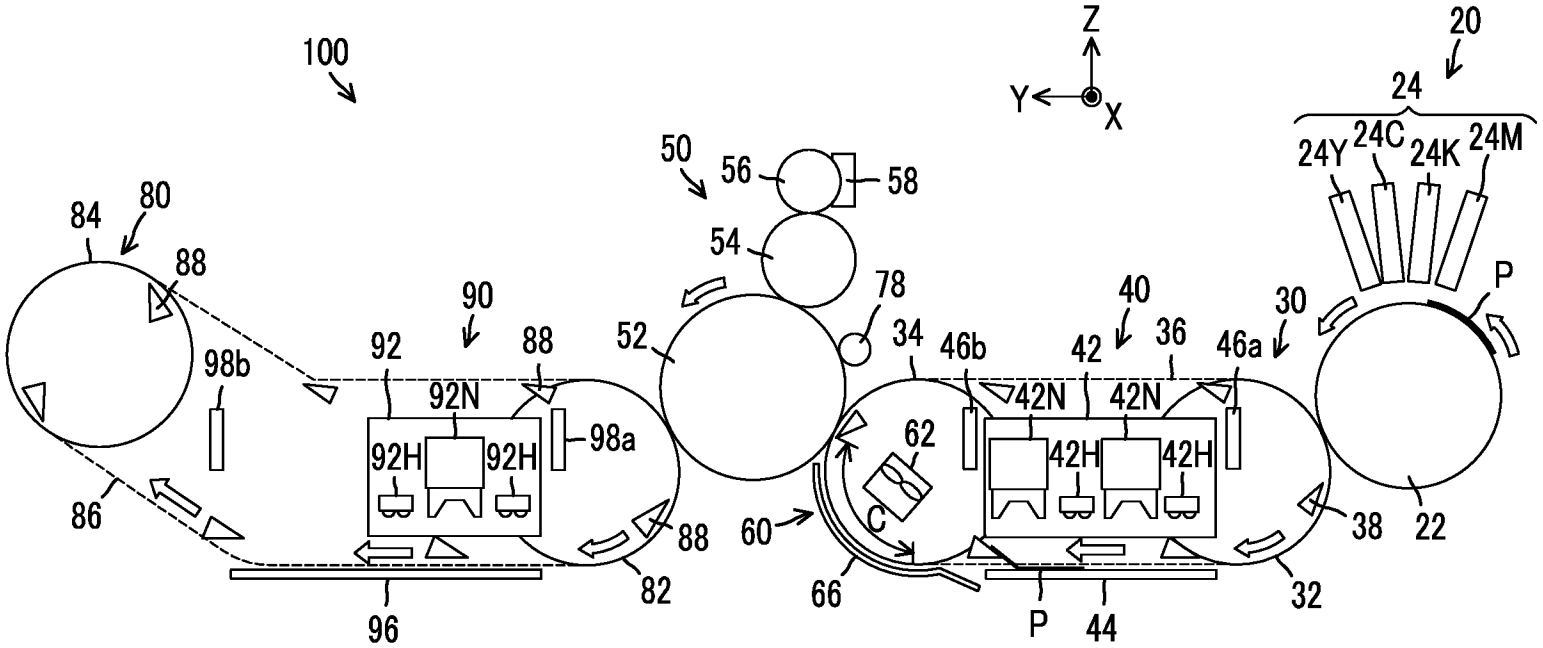
FIG. 10 is a diagram showing the entire structure of an ink jet recording apparatus.

FIG. 10 is a diagram showing the entire structure of an ink jet recording apparatus 100 according to a third embodiment. The ink jet recording apparatus 100 is different from the ink jet recording apparatus 10 shown in FIG. 1 in that the varnish pretreatment section 60 is provided with a cooling roller 78.

The cooling roller 78 (an example of a temperature adjusting roller) is cooling means for lowering the temperature of a sheet P by being in contact with the sheet P and absorbing heat from the sheet P; and includes a cylindrical drum that is rotated by the rotation of the varnish impression cylinder 52. The cooling roller 78 is biased toward the varnish impression cylinder 52 and pinches the sheet P between itself and the varnish impression cylinder 52 so that the outer peripheral surface of the cooling roller 78 is in contact with the recording surface of the sheet P. The cooling roller 78 is provided with a mechanism for cooling the cooling roller 78 itself, such as flow passages (not shown) in which a coolant is made to flow and/or vent passages (not shown) in which air is made to flow.

The cooling roller 78 is disposed in the transport path of the sheet P of the varnish impression cylinder 52 between a position where the sheet P is received from the first chain transport section 30 and a nip point between the varnish cylinder 54 and the varnish impression cylinder 52. Since the cooling roller 78 is disposed at this position, it is possible to cool the sheet P without increasing the length of the transport path of the sheet P.

Even in the case of the cooling roller 78, a collision between grippers (not shown) of the varnish impression cylinder 52 and the cooling roller 78 is also avoided by get-on bases (not shown).

Generally, a metal material, such as aluminum, having high heat conductivity is used for the cooling roller 78 in order to improve a heat absorption effect. Metal, such as steel, is also used for the varnish impression cylinder 52. Since metal and metal are in contact with each other as described above in a state in which the sheet P is not transported, there is a possibility that the surface of the varnish impression cylinder 52 and/or the cooling roller 78 may be damaged. Accordingly, a gap is formed between the outer peripheral surface of the varnish impression cylinder 52 and the outer peripheral surface of the cooling roller 78 so that a contact area between the metal of the cooling roller 78 and the metal of the varnish impression cylinder 52 is reduced as much as possible during an operation in a state in which the sheet P is not transported.

The varnish pretreatment section 60 having the above-mentioned structure guides the sheet P, which is transport by the first chain transport section 30, from the back of the recording surface by the guide board 66 and supplies the flow of air to the recording surface of the sheet P by the blower unit 62 to adjust the temperature of the recording surface of the sheet P. Further, the cooling roller 78 is in contact with the recording surface of the sheet P, which is transported by the varnish impression cylinder 52, and adjusts the temperature of the recording surface of the sheet P. Here, the temperature of the recording surface of the sheet P is adjusted to the desired temperature corresponding to the allowable value by the adjustment of the air volume of the blower unit 62 and the temperature itself of the cooling roller 78.

Accordingly, a relationship between the temperature of the recording surface at the time of application of varnish and the coating formation time of the varnish can satisfy Expression 1. Therefore, since it is possible to reduce a difference in glossiness in the in-plane direction of a printed matter on which varnish has been dried, a gloss difference ΔG, which is a difference between the glossiness Gy in the Y direction and the glossiness Gx in the X direction, can satisfy the allowable value Gp.

Here, the varnish pretreatment section 60 has included the blower unit 62 and the cooling roller 78, but may adjust the temperature of the recording surface of the sheet P to the desired temperature by using only the cooling roller 78 without including the blower unit 62. Further, the varnish pretreatment section 60 may be formed as a heating roller in a case in which the temperature of the recording surface is to be raised.

[Others]

The printing method according to this embodiment can also be formed as a non-temporary recording medium, such as a compact disk-read only memory (CD-ROM), in which a program for making a computer perform the respective steps described above is stored.

This embodiment can be applied to an apparatus that performs printing and the application of varnish in an in-line manner. The printing is not limited to an ink jet method of recording an image by ejecting ink from an ink jet head and may be any method that records an image on the recording surface of a recording medium with ink.

The technical scope of the invention is not limited to the scopes described in the above-mentioned embodiments. The components and the like of the respective embodiments can be appropriately combined with each other without departing from the scope of the invention.

EXPLANATION OF REFERENCES

10: ink jet recording apparatus
12: input section
14: CPU
16: control table
20: image recording section

22: transport cylinder
24: head unit
24C: ink jet head
24K: ink jet head
24M: ink jet head
24Y: ink jet head
30: first chain transport section
32: first sprocket
34: second sprocket
36: chain
38: gripper
40: ink drying-fixing section
42: heating-drying unit
42H: infrared heater
42N: hot air knife
44: guide board
46*a*: jam sensor
46*b*: jam sensor
50: varnish application section
52: varnish impression cylinder
54: varnish cylinder
56: varnish supply roller
58: varnish chamber
60: varnish pretreatment section
62: blower unit
66: guide board
78: cooling roller
80: second chain transport section
82: first sprocket
84: second sprocket
86: chain
88: gripper
90: varnish drying-fixing section
92: heating-drying unit
92H: infrared heater
92N: hot air knife
96: guide board
98*a*: jam sensor
98*b*: jam sensor
100: ink jet recording apparatus
120: image recording controller
130: first chain transport controller
140: ink drying-fixing controller
150: varnish application controller
160: varnish pretreatment controller
180: second chain transport controller
190: varnish drying-fixing controller
C: segment
P: sheet
S2 to S16: processing for measuring coating formation time tw of varnish
S22 to S52: processing of printing method

What is claimed is:

1. A printing apparatus comprising:

a recording section that records an image on a recording surface of a recording medium with ink;

a drying section that heats the recording medium to dry the ink of the recording surface;

a varnish application section that applies aqueous varnish containing water to the recording surface in a first direction after the recording medium is heated by the drying section, wherein when the temperature of the recording surface at the time of application of the aqueous varnish is denoted by Tp, coating formation time of the aqueous varnish is denoted by tw, and a constant determined according to an allowable value of a gloss difference, which is a difference between glossiness of the recording surface of a printed matter of which the applied aqueous varnish has been dried in the first direction and glossiness of the recording surface in a direction orthogonal to the first direction, is denoted by a; and a controller configured to control the varnish application section such that a relationship of Expression A is satisfied, $$Tp-(40/6)\times tw\leq a \qquad \text{(Expression A)},$$

here, the unit of the temperature Tp is ° C. and the unit of the coating formation time tw is minute, wherein when the allowable value is denoted by Gp, the allowable value is greater than or equal to zero, and a relationship of "a=5.2×Gp−26" is satisfied.

2. The printing apparatus according to claim 1, wherein the coating formation time tw is time that has passed until wrinkles are formed on the aqueous varnish present in a plastic vessel which includes a flat bottom having a diameter of 60 mm and in which 5 g of the aqueous varnish is put when the vessel is horizontally placed on a plate having a temperature of 80° C. and is then inclined at an angle of 45° with respect to the horizon.

3. The printing apparatus according to claim 1, further comprising a pretreatment section that is disposed between the drying section and the varnish application section and adjusts the temperature of the recording surface of the recording medium.

4. The printing apparatus according to claim 3, wherein the pretreatment section comprises a blowing unit that blows air to the recording surface.

5. The printing apparatus according to claim 3, wherein the pretreatment section comprises a temperature adjusting roller that is in contact with the recording medium and rotates.

6. The printing apparatus according to claim 3, further comprising:

an acquisition section that acquires the constant a and the coating formation time tw of aqueous varnish to be used; and a calculation section that calculates an upper limit of the temperature Tp satisfying Expression A at the acquired constant a and the acquired coating formation time tw, wherein the pretreatment section adjusts the temperature of the recording surface of the recording medium to a temperature that is lower than the upper limit of the temperature Tp.

7. The printing apparatus according to claim 6, comprising a table that stores an upper limit of the temperature Tp corresponding to each kind of the aqueous varnish.

8. The printing apparatus according to claim 3, further comprising:

an acquisition section that acquires the constant a and the temperature Tp of the recording surface of the recording medium adjusted by the pretreatment section;

a calculation section that calculates a lower limit of coating formation time tw satisfying Expression A at the acquired constant a and the acquired temperature Tp; and a selection section that selects aqueous varnish having coating formation time tw longer than the calculated lower limit of the coating formation time tw.

9. The printing apparatus according to claim 1, wherein the varnish application section comprises a varnish applying roller that is in contact with the recording surface of the recording medium and transfers and applies aqueous varnish, which is held on the surface of the varnish applying roller, to the recording surface.

10. A printing method comprising:

a recording step of recording an image on a recording surface of a recording medium with ink;

a drying step of heating the recording medium to dry the ink of the recording surface; and a varnish applying step of applying aqueous varnish containing water to the recording surface in a first direction after the recording medium is heated in the drying step, wherein when the temperature of the recording surface at the time of application of the aqueous varnish is denoted by Tp, coating formation time of the aqueous varnish is denoted by tw, and a constant determined according to an allowable value of a gloss difference, which is a difference between glossiness of the recording surface of a printed matter of which the applied aqueous varnish has been dried in the first direction and glossiness of the recording surface in a direction orthogonal to the first direction, is denoted by a, a relationship of Expression B is satisfied, $$Tp-(40/6)\times tw\leq a \quad \text{(Expression B)},$$

here, the unit of the temperature Tp is ° C. and the unit of the coating formation time tw is minute, wherein when the allowable value is denoted by Gp, the allowable value is greater than or equal to zero, and a relationship of "a=5.2×Gp−26" is satisfied.

* * * * *